United States Patent [19]

Peck et al.

[11] 3,982,705

[45] Sept. 28, 1976

[54] SLIDERLESS SHUTTLE AND WIRE GUIDE ASSEMBLY

[75] Inventors: Raymond A. Peck, New Fairfield; Leon J. Yarrish, Danbury, both of Conn.

[73] Assignee: Park Lane Research Corporation, Danbury, Conn.

[22] Filed: Apr. 23, 1975

[21] Appl. No.: 570,860

[52] U.S. Cl. ..... 242/4 B

[51] Int. Cl.[2] ..... H01F 41/08

[58] Field of Search ..... 242/4 R, 4 A, 4 B, 4 E

[56] References Cited

UNITED STATES PATENTS

| | | | |
|---|---|---|---|
| 2,653,771 | 9/1953 | Turner | 242/4 B |
| 3,054,566 | 9/1962 | Graham | 242/4 B |
| 3,601,325 | 8/1971 | Havasi | 242/4 B |

*Primary Examiner*—Edward J. McCarthy
*Attorney, Agent, or Firm*—Mattern, Ware, Davis & Stoltz

[57] ABSTRACT

A sliderless shuttle and wire guide assembly for toroidal coil winding machines provides unusually compact storage for winding wire or tape carried by the shuttle. The novel cross-sectional configuration of the shuttle permits winding of extremely small toroidal cores. An adjustable and retractable wire guide assembly permits the use of different size shuttles for wire or insulating tape having a wide range of sizes, while also providing valuable protection against escaping coils of broken wire or the release of a "flying" empty shuttle from the coil winding machine.

11 Claims, 4 Drawing Figures

SLIDERLESS SHUTTLE AND WIRE GUIDE ASSEMBLY

This invention relates to toroidal coil winding machines, and particularly to a novel assembly of an adjustable and retractable wire guide embracing a new shuttle of unique design.

BACKGROUND OF THE INVENTION

Prior Art

Many types of toroidal coil winding machines are available on the market, and one typical coil winding device is disclosed in U.S. Pat. No. 3,400,894 where a split-ring, breakaway wire-carrying shuttle 22 interlinked with a toroidal core 20, is provided with an outwardly facing peripheral groove within which wire is wrapped during a loading operation. The shuttle is supported on a plurality of support sheaves 49, 51, 52 and 53, all rotatably mounted on an adjacent head assembly 21. At least one of these sheaves if rotatably driven to supply traction drive for high speed rotation of the shuttle 22. The interlinked core 20 is likewise supported and rotatably driven at a slower speed on a core holdler assembly 19. These various parts are illustrated in the figures of U.S. Pat. No. 3,400,894, and are indicated by the same reference numerals in the figures hereof.

U.S. Pat. No. 3,601,325 describes the disadvantages of conventional shuttles 16 carrying sliders 17 for sliding movement about their peripheries. These sliders have traditionally been employed to control the delivery of wire wound in the outwardly facing peripheral groove of the shuttle itself, by retarding its release and thereby maintaining its tension during the winding operation. The slider progresses slowly backward around the periphery of the shuttle during the winding operation, impelled by the unwrapped segment of wire being drawn from the shuttle and wound around the toroidal core during the winding of each turn of wire thereon.

While these conventional sliders successfully maintain tension on the stored wire, they require precision machining of the shuttles to accommodate them and they increase the overall cross-sectional area of the shuttle, thereby limiting the minimum internal diameter of toroidal cores which can be wound through the use of such slider-carrying shuttles. For this reason, U.S. Pat. No. 3,601,325 discloses a proposed "sliderless shuttle " carrying an elastic belt 18 encircling a major portion of the shuttle's periphery and diverging from the shuttle at a point 20A just before it reaches the toroidal core, passing around an idler roller and returning to the shuttle just beyond the core, at a point 20B.

While this elastic-belt wire-retainer serves to reduce the overall cross-section of the shuttle assembly passing through the toroidal core, it exhibits several disadvantages. For example, the belt tension varies with rotational velocity of the shuttle, since the belt's forward velocity is essentially matched to the shuttle's angular velocity. At higher speeds, centrifugal force urges the belt away from the stored wire carried in the outwardly facing peripheral groove of the shuttle, precisely when greater retaining force is desired to avoid centrifugal release of the stored turns of wire. At the same time, this radial expansion tendency of the belt at higher speeds reduces the frictional force exerted by the belt on the turn of wire being drawn from the shuttle. Again, the forces exerted by the stretched elastic belt on the rearward sector of the shuttle tend to deform the shuttle and may cause it to jump from its supporting sheaves and fly off, spinning in its plane of rotation, endangering nearby personnel as the last stored turns of wire are drawn from the shuttle. If outward radial acceleration forces on the retaining belt sufficiently reduce the elastic forces tending to retain the belt on the shuttle, the belt itself may be released and may fly off, removing the wire retaining structure entirely and allowing loose coils of wire to spill before the machine can be shut down. Finally, the elastic belt of U.S. Pat. No. 3,601,325 passes directly around the core on the core holder, obscuring the operator's view. In many situations these various disadvantages are not encountered, but their likelihood in certain situations makes a more reliable sliderless shuttle and protective wire guide mechanism highly desirable in the toroidal coil winding field.

SUMMARY OF THE INVENTION

The sliderless shuttle devices of the present invention provide a unique cross-section, maximizing the volume of tape or turns of wire which may be carried by the shuttle while minimizing the cross-sectional area and dimensions of the shuttle. By this means, many turns of fine wire can be wound on extremely small toroidal cores. The wire guide assemblies of the present invention are shaped as a pair of sector guides, together embracing a major portion of the periphery of the shuttle in its winding position, interlinked with a toroidal core. These wire guide sectors are resiliently retained in closed position closely embracing the shuttle, and they contain bristle material extending radially inward, directly toward the shuttle and into gentle brushing frictional contact with the outermost turns of wire in the shuttle's wire storage groove. By substituting stiffer or softer bristle material of different density or thickness, different wire sizes ranging from heavy wire to ultrafine wire may be accommodated by the winding devices of this invention. Because it is not required to carry a slider or to mate with special flanged sheaves for traction driving support, the shuttles of the present invention need not have the irregular shapes and internal ribbed configurations of prior art shuttles, which thereby lost substantial portion of the wire storage area of their cross-sections. The shuttles of this invention, with simplified, U-shaped cross-sections, provide a wide, deep wire carrying groove having a maximum wire storage capability combined with a minimum shuttle cross-sectional area and minimum cross-sectional dimensions.

The simplified shuttles of this invention suffer no wear from the effects of sliding contact of any slider devices, and they may be driven by elastomer-rimmed drive sheaves, further reducing shuttle wear. By eliminating encircling belts and idler pulleys, the minimum number of moving parts is achieved: the shuttle itself. The stationary wire guide sectors experience no outward centrifugal acceleration forces. They may be precisely adjusted and they maintain themselves in position regardless of shuttle rotational velocity. Being stationary, these same shuttle wire guide sectors effectively prevent the escape of extra turns of wire from the shuttle and the sudden release of the shuttle itself after all of the wire has been unwound, thereby destroying the constricting effect of the wire upon the shuttle. The guide sectors also maintain uniform wire or tape tension at all winding speeds.

Even when outward radial centrifugal acceleration forces on the split-ring shuttle are no longer counteracted by such constricting effect of turns of wire wound thereon, the radial outward deflection of the shuttle is effectively resisted by the wire guide sectors of the present invention, retaining empty shuttles in position on the coil winding machine and minimizing or eliminating the danger of flying shuttles and the risks to nearby personnel therefrom.

Accordingly, a principal object of the present invention is to provide simplified and inexpensive sliderless shuttle assemblies for toroidal coil winding machines eliminating costly sliders.

Another object of the present invention is to provide such sliderless shuttle assemblies incorporating shuttles of simplified cross-sectional shape having large wire carrying capacity.

A further object of the invention is to provide such sliderless shuttles having a minimum cross-sectional area, permitting the winding of coils on miniature toroidal cores of extremely small diameter.

A further object of the invention is to provide such sliderless shuttle assemblies capable of minimizing the risk of escaping turns of wire and of flying shuttles escaping from the device.

Still another object of the invention is to provide such sliderless shuttle assemblies capable of winding wire having a wide range of diameters, and of winding tape of different width and thickness, at uniform tension.

Other and more specific objects will be apparent from the features, elements, combinations and operating procedures disclosed in the following detailed description and shown in the drawings.

THE DRAWINGS

Figure 3:
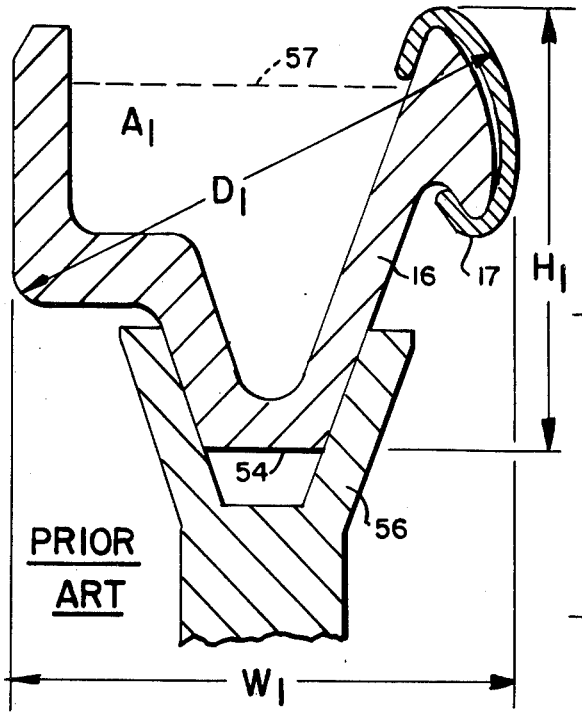
Figure 4:
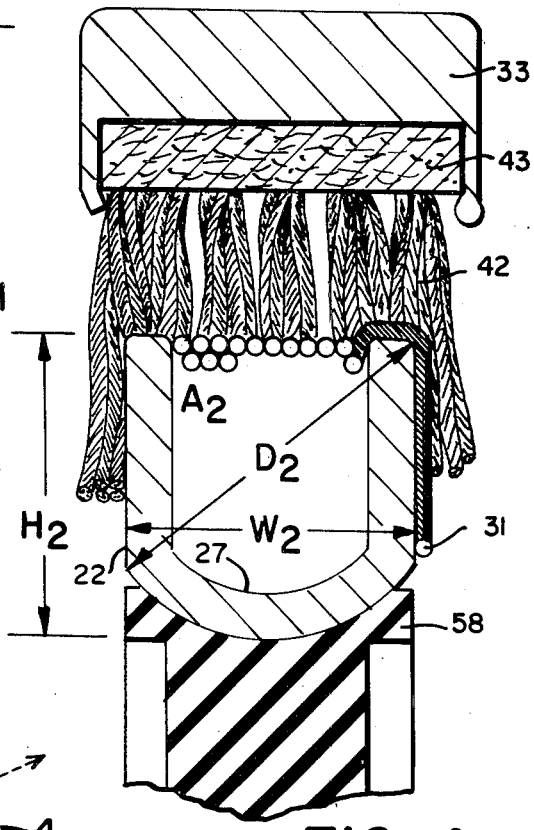
Figure 2:
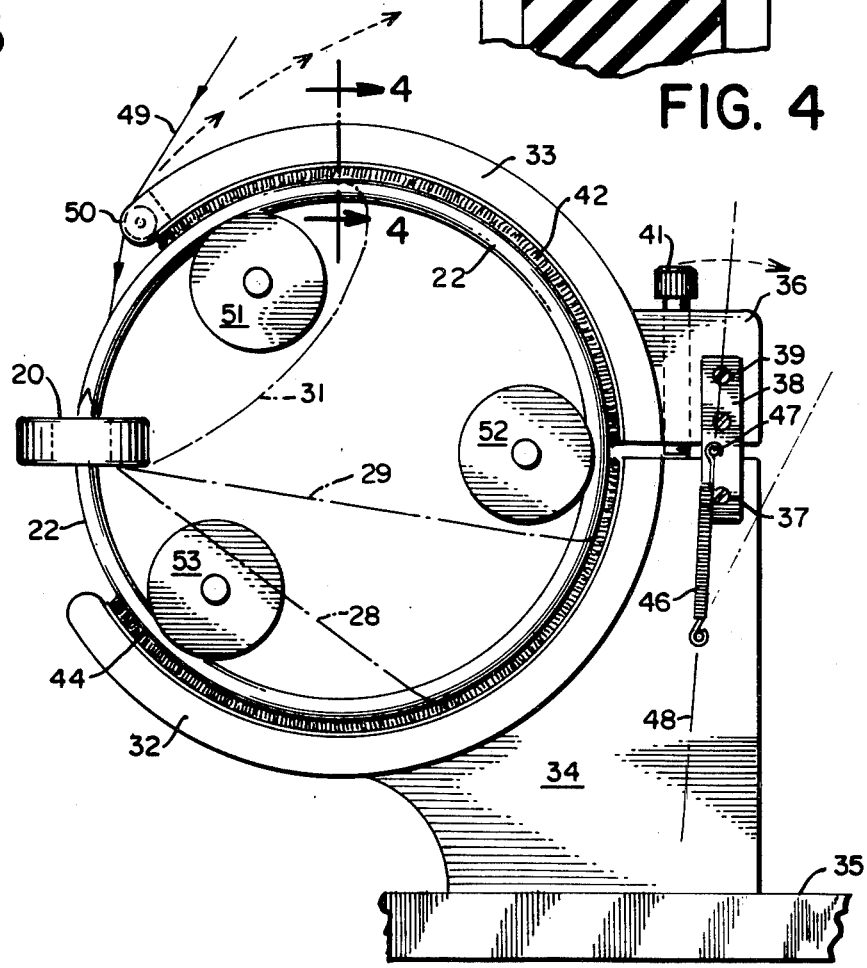
FIG. 2 is a fragmentary side elevation view of the sliderless shuttle with the supporting sheaves and the interlinked toroidal core shown in FIG. 1, illustrating the engaged configuration of the wire guide sectors embracing the sliderless shuttle.

FIG. 3 is a greatly enlarged fragmentary cross-sectional elevation view of a conventional wire carrying shuttle incorporating a slider and mounted on a driving sheave; and FIG. 4 is a corresponding greatly enlarged fragmentary cross-sectional elevation view, taken along plane 4—4 in FIG. 2, showing a sliderless shuttle of the present invention mounted on an elastomer-rimmed drive sheave and cooperating with an overlying wire guide sector having wire retaining bristle material extending inwardly toward the rim of the shuttle.

THE WINDING STATION

Figure 1:
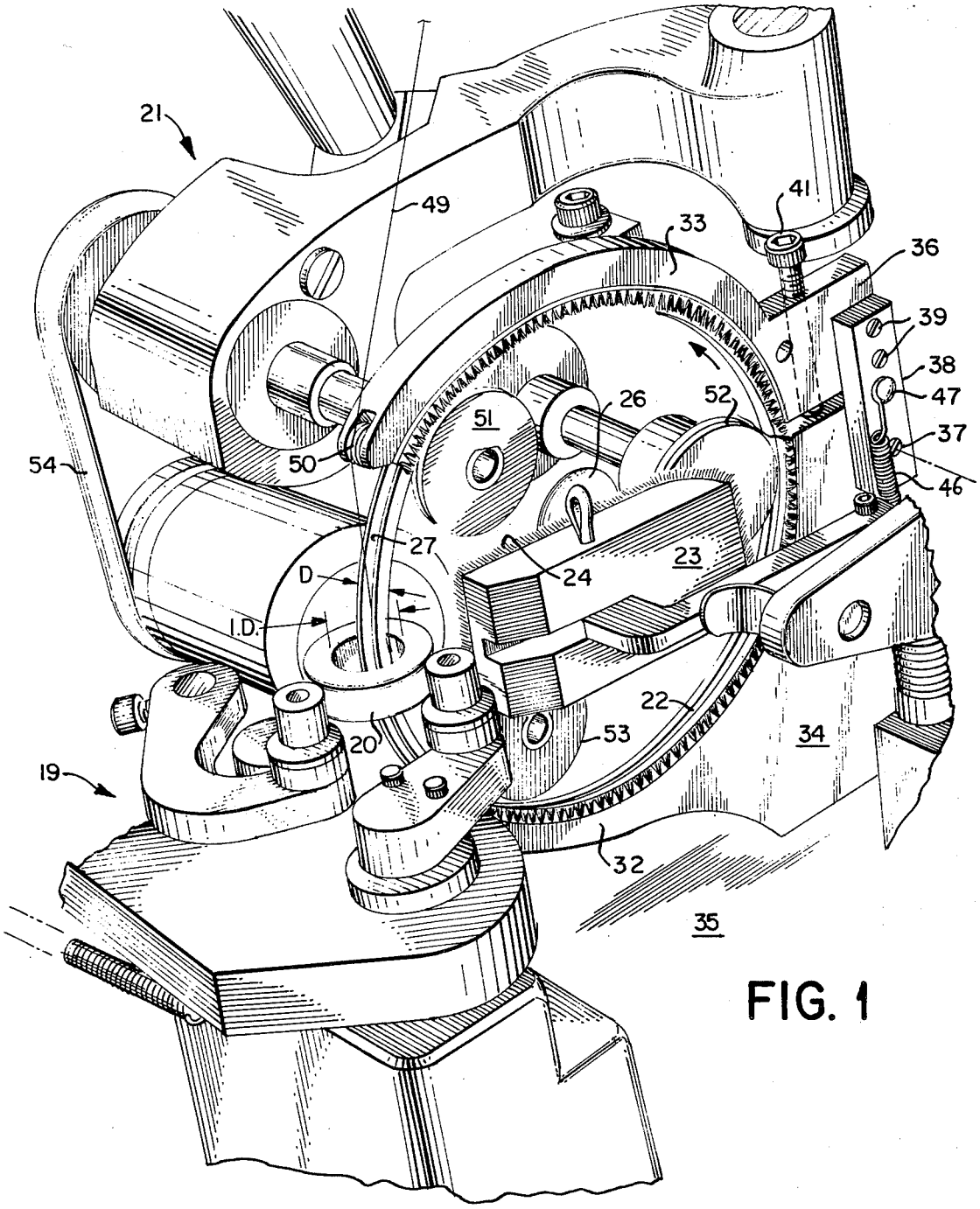
FIG. 1 is a fragmentary perspective view of the winding station of a toroidal coil winding machine incorporating the present invention, showing a sliderless shuttle mounted on a winding head and interlinked with a toroidal core mounted on an adjacent core holder assembly.

The principal sub-assemblies characterizing many toroidal coil winding machines are shown in FIG. 1, where a core holder assembly 19 in the foreground supports and rotatably drives a toroidal core 20 for slow speed rotation about its own axis in a conventional manner.

An adjacent head assembly 21 in the background supports a scarf-jointed split ring shuttle 22 interlinked with the toroidal core 20. Shuttle 22 is supported and drivingly engaged encircling the peripheries of a plurality of rotatable drive sheaves 51, 52 and 53 turned by an elastic drive belt 54 encircling drive pulleys mounted on the remote ends of rotatable, bearing-mounted shafts on which the shuttle-carrying sheaves 51, 52 and 53 are mounted. Drive belt 54 is shown at the left hand side of FIG. 1.

A friction shoe assembly 23 in the foreground of the mechanism illustrated in FIG. 1 corresponds generally to the friction shoe assembly shown in FIGS. 10 and 14 of U.S. Pat. No. 3,400,894. The friction shoe 23 is pivotally retractable out of the plane of shuttle 22 for removal of the shuttle from the mechanism, and friction shoe assembly 23 is pivotally mounted for engaged installation in the position shown in FIG. 1. Shoe assembly 23 is provided with bristle material protruding from its far side (as seen in FIG. 1) into the plane of shuttle 22 toward a fixed shoe 26 extending from head assembly 21 toward the plane of shuttle 22. Fixed shoe 26 mounted just beyond the plane of shuttle 22 often incorporates optical or electronic turn counting devices, and has a smoothly curved face over which each turn of wire slides with minimum friction drag. As shown in FIG. 3 of U.S. Pat. No. 3,601,325 and FIG. 2 hereof, rotation of shuttle 22 in a counter-clockwise direction allows a one-turn length of wire previously wound in the outer peripheral groove 27 of shuttle 22 to be released for winding about the core 20. With each revolution of shuttle 22, this released length of wire sweeps through a series of positions 28, 29 and 31. Over a large portion of this path of travel, sweeping continuously through these successive positions, the released loop of wire passes between the bristle material on retractable friction shoe 23 and the juxtaposed fixed friction shoe 26 shown in FIG. 1. In this manner the friction shoe assembly serves to retain tension upon the wire loop, assuring that the resulting turn of wire formed around core 20 will be tight and uniform, arrayed directly beside the previous turn with uniform tension.

WIRE GUIDE SECTORS

As shown in FIGS. 1 and 2, a pair of arcuate wire guide sectors 32 and 33 together embrace the major portion of the periphery of shuttle 22. The lower wire guide sector 32 forms a forwardly extending portion of a wire guide pedestal 34 fixedly mounted on the base plate 35 of the toroidal coil winding machine station. The lower wire guide sector 32 subtends an arc of approximately 150°, extending from the rearward center portion of the shuttle, downward and forward around the major portion of the shuttle's lower periphery to a point approximately 30° below the core 20.

The upper wire guide sector 33 forms a forwardly extending portion of a guide block 36 pivotally mounted on guide pedestal 34 and having an engaged position as shown in FIG. 2. Guide block 36 is free for retractable pivoting movement in the direction of the dashed arrows, pivoting about the axis of a pivot pin 37 pivotally joining a guide plate 38 of block 36 to the guide pedestal 34 at a pivot point spaced rearwardly from the rim of the shuttle 22 and slightly below its central axis. The guide plate 38 is firmly anchored by such means as the two screws 39 to the guide block 36, assuring that guide block 36 with its integral wire guide sector 33 and guide plate 38 pivot together as a unitary structure about the axis of pivot pin 37.

An adjustable threaded stop screw 41 mounted in a threaded bore extending downward through guide block 36 protrudes therefrom into engagement with guide pedestal 34. Rotational adjustment of the stop screw 41 raises or lowers the engaged position of upper sector 33 relative to lower sector 32, as indicated in FIG. 2. The inwardly protruding bristle material 42 anchored in a support pad 43 is secured by adhesive or by firm frictional engagement within the inner periphery of top sector 33, as shown in FIGS. 2 and 4. Bristle material 42 extends radially inward into gentle brushing engagement with the rim of shuttle 22 and the turns of wire carried in its peripheral groove 27. A corresponding body of inwardly protruding bristle material 44 is similarly mounted around the inner periphery of lower guide sector 32, as shown in FIG. 2.

A biasing spring 46, preferably formed as an extension coil spring, has its lower end anchored to the guide pedestal 34 at a point below and slightly forward of pivot pin 37, while the upper end of biasing spring 46 is secured to the upper pivoting assembly by such means as an anchor screw 47 secured to the guide plate 38 at a point above and slightly forward of pivot pin 37. In the engaged position of the pivoting upper wire guide sector 33, the line of action along which extension spring 46 applies its tension force is represented by the dot-dash line 48 shown in FIG. 2, which lies slightly forward of the pivot point 37. By this means, the tension force provided by spring 46, slightly extended in this engaged position, resiliently biases upper wire guide sector 33 downward toward the outer periphery of shuttle 22, causing deformation of the bristle material 42 into tractive engagement with the turns of wire in groove 27 of the shuttle 22 as indicated in FIG. 4.

Loading Procedure

When upper wire guide sector 33 is moved pivotally about pivot pin 37 following the dashed arrows shown in FIG. 2, the bristle material 42 is lifted from the turns of wire in groove 27 and stop screw 41 is lifted from guide pedestal 34. Spring 46 is correspondingly stretched until its line of tensile force passes the axis of pivot pin 37 in an angular rearward direction. Beyond this point, further pivoting movement of the assembly 33–36–38 about pivot pin 37 permits spring 46 to retract slightly as its line of action 48 swings past the axis of pivot pin 37. The tension force supplied by spring 46, tending to draw its upper anchor point 47 downward, resiliently biases the pivoting upper guide sector assembly 33–36–38 toward a rearward retracted position. In this retracted position, the scarf-jointed shuttle may be spread and removed from the drive sheaves 51, 52, and 53, and disengaged from the core 20, to permit the changing of core or shuttle. A new shuttle, spread and interlinked with the core 20, may then be restored to its ring-shaped condition engaged on the outer periphery of drive sheaves 51, 52 and 53, and the upper wire guide sector 33 may be pivoted forward about pivot pin 37 into its engaged position shown in FIG. 2.

A new length of wire from rearward overlying wire storage reels may then be drawn down along path 49 shown in FIGS. 1 and 2 over a small loading sheave 50 rotatably mounted at the distal end of guide sector 33, and thence downward into winding engagement with the groove 27 in shuttle 22 in a conventional manner. After the free end of fresh wire led downward along path 49 over loading sheave 50 is secured in the groove 27 of shuttle 22, the shuttle may be revolved rapidly in a counter-clockwise direction as viewed in FIGS. 1 and 2, winding the desired number of turns in groove 27 until the outermost level of loaded wire illustrated in FIG. 4 lies substantially at the outer rim of shuttle 22.

During this winding operation, bristle material 42 extends into groove 27, retaining the wound turns of wire in place. When the winding operation is completed, the shuttle's rotation is halted and the remaining free end of wire is wrapped clockwise around the rearward portion of core 20 to begin the winding operation. Revolution of shuttle 22 in the counter-clockwise direction is then resumed to deliver successive turns of wire from shuttle 22 as wire loops sweeping through positions 28, 29 and 31 shown in FIG. 2 to form each successive turn of wire about the core 20 as the core is slowly rotated on the core holder assembly 19.

A tape loading guide roller may be substituted for wire loading sheave 50 when insulating tape is to be loaded and wound on the device.

From the position of sheave 50 at the distal end of upper wire guide sector 33, at a point spaced angularly upward from core 20 by approximately 50°, over and around the remaining periphery of the shuttle out to the distal end of lower wire guide sector 32 at a point approximately 30° below the core 20, the entire periphery of shuttle 22 is embraced by bristle material 42 and 44 extending from the wire guide sectors 33 and 32 toward the wire turns lying in groove 27 of shuttle 22. By this means, only the closing free loop 31 of wire actually being wound about core 20 during each consecutive rotation of shuttle 22 is free to be drawn past bristle material 42 over the rim of shuttle 22, as shown in FIG. 4. All of the remaining turns of wire are firmly held in place by bristle material 42, and undesired and troublesome spillage of extra wire loops is thereby avoided.

SLIDERLESS SHUTTLES

The respective cross-sections of a prior art shuttle 16, shown in FIG. 3, and the novel shuttle 22 of the present invention, shown in FIG. 4, clearly demonstrate that their respective wire storage areas A1 and A2 are approximately the same, while their actual dimensions are very different. Prior art shuttle 16 is provided with an inwardly protruding drive flange 54 having an inwardly tapered configuration matching the outwardly tapered flanges of a drive sheave 56 also shown in FIG. 3.

The turns of wire loaded into the radially outwardly facing groove of prior art shuttle 16 cannot extend to the outermost rim of shuttle 16 because of the presence of slider 17 thereon. Accordingly, a lower level 57 beneath the inturned flange of slider 17 constitutes the outer radial limit beyond which turns of wire cannot be loaded onto the shuttle 16. Therefore, because of its irregular cross-sectional area and reduced diameter of loading capacity, the shuttle 16 has a substantial width W1 and height H1, and a maximum dimension D1 greater than either of these which comprises the dimension governing the minimum internal diameter of the toroidal coil which can be wound utilizing the prior art shuttle 16. This is clearly shown in FIG. 1, where the dimension D of the shuttle is shown passing through the central aperture having an internal diameter I.D. of the toroidal core 20.

By contrast, the unique shuttle 22 of the present invention has a much smaller height H2 and width W2, and a maximum dimension D2 for a comparable area A2, permitting the same number of turns of wire to be wound upon a much smaller toroidal core because of the simplified, regular U-shape of shuttle 22. In addition, the smooth rounded and unflanged internal periphery of shuttle 22 adapts it to by engaged by an elastomer rimmed drive sheave 58, as shown in FIG. 4. The simplified design of the unique shuttles 22 of the present invention substantially reduces their manufacturing cost since far less machining is involved, and the shuttles of this invention can thus be made for two-thirds the cost of prior art shuttles 16. The simplified sliderless shuttles 22 also provide easier loading capabilities, for wire need not be inserted into a small hole or notch of the slider, which has now been totally eliminated. The elimination of sliders and the resulting reduced wear on the rims of the shuttle, and the use of elastomer rimmed drive sheaves 58 provides greatly extended useful life for shuttles 22, significantly reducing the cost of core winging operations with the present invention. The only expendable material is bristle material 42, which can be conveniently replaced from time to time as required.

A highly significant advantage of the clamshell type of pivoted wire guide sector assembly 32–33 here disclosed is the substantial elimination of flying shuttles which sometimes escape from conventional coil winders after the winding operation is completed and all loaded turns of wire have dispensed, releasing the centrifugal force acting on the shuttle to reduce its tractive engagement with the drive sheaves and sometimes permitting the shuttle to open, disengage from its interlinked relationship with the core 20 and fly off spinning in its rotational plane, creating a hazard for nearby personnel. Being almost totally embraced by the wire guide sectors 32 and 33, such unloaded shuttles are retained and prevented from escaping, greatly enhancing operator safety with the devices of this invention.

It will thus be seen that the objects set forth above, among those made apparent from the preceding description, are effeciently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved toroidal coil winding shuttle assembly incorporating:

A. a scarf-jointed ring-shaped sliderless shuttle adapted to be interlinked in relative rotatable engagement with a toroidal core and having a wire or tape storage groove facing radially outward formed around its periphery, B. supporting means positioning the shuttle for relative rotational interlinked movement through the central aperture of the toroidal core, C. shuttle-engaging drive means providing driving torque causing said shuttle to rotate about its axis, and D. a core-supporting and driving core holder positioning a toroidal core interlinked with said shuttle and causing said core to rotate about its own axis, E. wherein the improvement comprises a concave wire guide embracing a substantial portion of the outer peripheral rim of said shuttle and incorporating depressible friction material protruding inwardly therefrom into brushing engagement with the shuttle's rim and with turns of wire or tape would in the wire or tape storage groove of said shuttle.

2. The improved coil-winding shuttle assembly defined in claim 1 wherein the concave wire guide is closely juxtaposed to the rim of the shuttle over a major sector of its periphery.

3. The improved coil-winding shuttle assembly defined in claim 1 wherein the concave wire guide is formed in separate adjoining sectors movably joined together for relative movement between an engaged position and a disengaged position in which at least one of the sectors is retracted away from the rim of the shuttle.

4. The improved coil-winding shuttle assembly defined in claim 3 wherein the retractable sector is resiliently biased toward its engaged position.

5. The improved coil-winding shuttle assembly defined in claim 4 wherein the retractable sector is pivotally hinged to the adjoining sector, and further including a resilient spring cooperating with the two sectors and urging the retractable sector toward the adjoining sector.

6. The improved coil-winding shuttle assembly defined in claim 3, further including adjustable stop means interposed between the retractable sector and the adjoining sector to limit the extent of the relative movement toward the engaged position, governing the proximity of approach of the retractable sector to the shuttle's rim in the engaged position.

7. The improved coil-winding shuttle assembly defined in claim 1, further including a loading sheave rotatably mounted on the wire guide near the shuttle's rim substantially in the plane of the shuttle, and positioned for guiding a wire traveling from a storage reel past the wire guide toward the shuttle during shuttle-loading, wire-winding rotation of the shuttle.

8. The method of winding wire on a toroidal core comprising the steps of:

A. providing a scarf-jointed ring-shaped shuttle adapted to be interlinked in relative rotatable engagement with a toroidal core and having a wire storage groove facing radially outward formed around its periphery, B. supporting said shuttle for relative rotational movement interlinked through the central aperture of a toroidal core, C. supplying wire to said shuttle while simultaneously loading said wire into the groove of said shuttle by rotating said shuttle in a first direction, D. subsequently rotating said shuttle in the same first direction to wind said wire from said shuttle groove around said core, while E. applying stationary flexible friction material in brushing contact with slight radial inward force against the outer peripheral rim of the ring-shaped shuttle and against turns of wires wound in the shuttle's groove during said loading and winding operations.

9. The toroidal coil winding method defined in claim 8 wherein the segment of wire delivered during each winding revolution of the shuttle in said first direction is drawn over the rim of the shuttle toward the core by deflecting the overlying flexible friction material.

10. A sliderless wire-carrying scarf-jointed ring-shaped shuttle for toroidal coil winding machines having a substantially U-shaped thin-walled cross-section of approximately uniform wall thickness forming a radially outward-facing wire storage groove of high capacity bounded on its radially innermost boundary by a thin base wall of substantially uniform radius across its axial width as measured radially from the axis of the ring-shaped shuttle, with said thin base wall being smoothly blended into thin side walls without indentations.

11. A sliderless wire-carrying scarf-jointed ring-shaped shuttle for toroidal coil winding machines having a substantially U-shaped thin-walled cross-section of approximately uniform wall thickness forming a radially outward-facing wire storage groove of high capacity bounded on its radially innermost boundary by a thin base wall of substantially uniform radius across its axial width as measured radially from the axis of the ring-shaped shuttle, wherein the base wall is provided with a diametric arcuately curved cross-section having a convex arc arched inwardly for tractive engagement with a concavely grooved resiliently rimmed driving sheave.

* * * * *

UNITED STATES PATENT AND TRADEMARK OFFICE

CERTIFICATE OF CORRECTION

PATENT NO. : 3,982,705
DATED : September 28, 1976
INVENTOR(S) : Raymond A. Peck
Leon J. Yarrish It is certified that error appears in the above-identified patent and that said Letters Patent are hereby corrected as shown below:

Column 1, line 22 - "if" should be --is--;

Column 1, line 26 - "holdler" should be --holder--;

Column 2, line 47 - "portion" should be --portions--;

Column 7, line 23 - "winging" should be --winding--;

Column 7, line 44 - "effeciently" should be --efficiently--;

Column 8, line 10 - "would" should be --wound--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*